United States Patent [19]

Greco et al.

[11] Patent Number: 4,536,139

[45] Date of Patent: Aug. 20, 1985

[54] DIAPHRAGM PUMP

[75] Inventors: Claudio Greco; Silvano Blandino, both of Turin, Italy

[73] Assignee: Societa' Impianti Elettrici Telefonici Telegrafici E Costruzioni Edili, Florence, Italy

[21] Appl. No.: 501,792

[22] Filed: Jun. 7, 1983

[30] Foreign Application Priority Data

Jun. 8, 1982 [IT] Italy ..... 22121/82[U]

[51] Int. Cl.[3] ..... F04B 43/14

[52] U.S. Cl. ..... 417/471; 417/471; 285/DIG. 22

[58] Field of Search ..... 417/470, 471, 454; 92/59, 98 R; 285/DIG. 22

[56] References Cited

U.S. PATENT DOCUMENTS

| | | | |
|---|---|---|---|
| 2,834,299 | 5/1958 | Coffey | 417/471 |
| 3,186,351 | 6/1965 | Bradley | 417/471 |
| 3,238,967 | 3/1966 | Smith | 417/471 |
| 3,314,365 | 4/1967 | Ritchie | 417/471 |
| 3,771,907 | 11/1973 | Neumann | 417/470 |
| 3,842,870 | 10/1974 | Burgess | 285/DIG. 22 |
| 3,948,547 | 6/1976 | Gache | 285/DIG. 22 |
| 4,152,017 | 5/1979 | Abramson | 285/DIG. 22 |
| 4,232,473 | 11/1980 | Jenkins | 285/DIG. 22 |

FOREIGN PATENT DOCUMENTS

| | | | |
|---|---|---|---|
| 2060182 | 7/1971 | Fed. Rep. of Germany | 417/454 |
| 1220249 | 1/1971 | United Kingdom | 285/DIG. 22 |

*Primary Examiner*—William L. Freeh

*Attorney, Agent, or Firm*—Donald J. Lenkszus

[57] ABSTRACT

A diaphragm pump particularly adapted for use as a fuel pump includes separate caps having pipe unions extending therefrom. The caps are snap-engageable with the pump body.

7 Claims, 2 Drawing Figures

DIAPHRAGM PUMP

BACKGROUND OF THE INVENTION

The present invention relates to a diaphragm pump, particularly for supplying fuel to an internal combustion engine.

Pumps of this type comprise a lower body and an upper body with mating annular peripheral flanges between which the periphery of the diaphragm is gripped. The lower body contains a mechanism for deforming the diaphragm in a reciprocating manner. The upper body internally contains two housings. The two housings contain respectively an automatic intake valve and an automatic delivery valve through which a chamber overlying the diaphragm is put into communication with an intake pipe union and a delivery pipe union respectively. The intake and delivery pipe unions branch from corresponding spaces overlying the respective valves.

In some known pumps of a first type, the intake and delivery pipe unions are carried by the upper body of the pump in fixed orientations and positions.

In other known pumps of a second type, the two pipe unions are carried, also in fixed orientations and positions, by a lid formed from sheet metal which covers and surrounds the upper body. The lid has a lower edge that keeps the flanges of the two bodies together by seaming, as well as retaining the lid in position.

Because of the fixed orientations and positions of the pipe unions in both these types of pump, it is not possible, for example, in the case of motor vehicles, to use standarized pumps which are suited to the requirements of various models of motor vehicles, these requirements being created by the differences of positioning and orientation of the fuel intake and delivery pipes which exist between one vehicle model and another.

In pumps of the second type, there are also sealing problems between the delivery and intake zones defined by the upper body and the lid.

The manufacturers of diaphragm pumps are forced to design upper bodies or lids of several different types, with pipe unions arranged in different ways.

Thus, repairers are also forced to choose from several types of diaphragm pumps to find one which has the specific pipe union arrangement corresponding to the positions and orientations of the piping with which the unions are to be connected. Hence, it would be desirable to provide a so-called universal diaphragm pump, that is, one in which the position and orientation of the pipe unions would be adaptable to different requirements.

One object of the invention is to provide a pump which satisfies this desire while not having the sealing problems of the second type of known pump.

SUMMARY OF THE INVENTION

According to the present invention this and other objects are achieved by means of a diaphragm pump of the type mentioned initially, characterised in that the upper body has a pair of separate cavities arranged side by side, each of which houses one of the valves and has an upper bell-shaped annular part of revolution, and in that associated with each cavity is a cap separate from the upper body, from which a pipe union branches and which has a skirt of revolution engaged in the bell-shaped part, the bell-shaped part and/or the skirt being resilient, and/or the skirt and the bell-shaped part having cooperating snap-engageable members and facing radial surfaces between which an annular sealing washer is clamped.

By virtue of this solution, in order to adapt a pump according to the invention to a given arrangement of the supply and delivery piping, it suffices to snap-engage caps which have pipe unions oriented in the more suitable manner on the bell-shaped part of the upper body. For example, caps may be provided with pipe unions which are directed upwardly, laterally or even branching laterally from the cap and forming an elbow so as to project downwardly.

In case of the pipe unions projecting or branching laterally, the same cap may be snap-engaged with the respective bell-shaped part in different angular positions to achieve different orientations of its pipe union, as a result of the forms of revolution of the snap-engaged parts.

In a pump according to the invention, the only parts which may change according to the type of installation are the caps.

In the supply of replacement pumps, each pump may simply be provided with an assortment of caps with differently arranged pipe unions so that the installer may choose the two most suitable caps for the intake and the delivery.

In a diaphragm pump according to the invention, the problem of sealing between the intake and delivery zones, which was present in the second type of known pumps, is also solved. Indeed, since there is no longer a single lid but two distinct caps, it is no longer possible for fuel to leak from the delivery zone to the intake zone.

BRIEF DESCRIPTION OF THE DRAWING

The invention will be better understood from reading the detailed description which follows with reference to the appended drawings, given by way of non-limiting example, in which.

DETAILED DESCRIPTION

Figure 1:
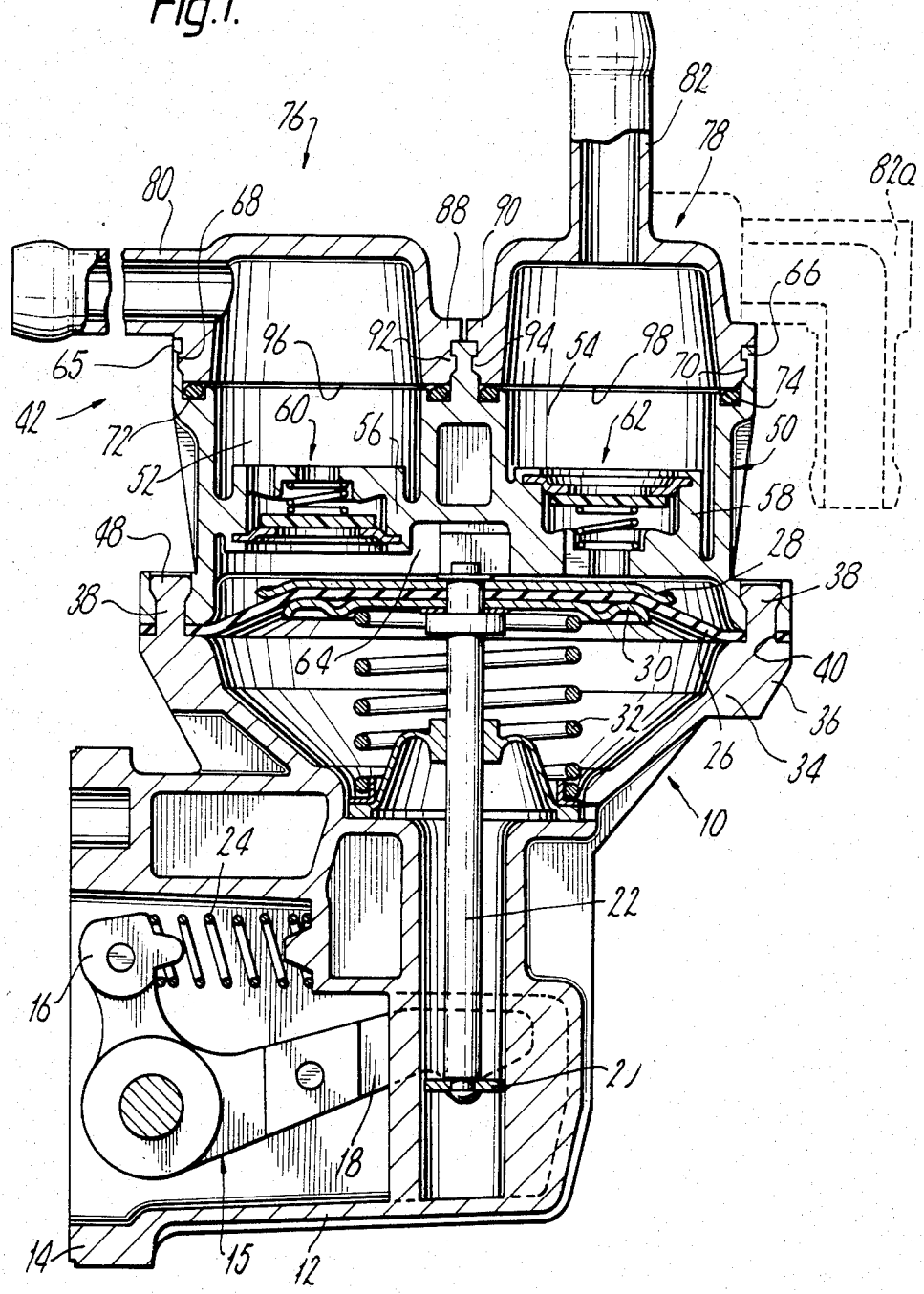
FIG. 1 is a longitudinal section of a diaphragm pump according to the invention.

Referring to the drawings, a pump includes a lower hollow body, generally indicated 10. The body 10 is of rigid thermoplastics material.

A lower housing part 12 of the body 10 is provided with a flange 14 for attachment to, for example, the engine block of a motor vehicle.

In the housing part 12 a bell-crank lever 15 is pivotally supported and has a feeler arm 16 for cooperating with a cam of a camshaft of the engine.

The other arm 18 is fork-shaped and engages a disc 20 fixed to the lower end of a rod 22. The lever 15 is acted on by a helical spring 24 which urges the feeler arm 16 into engagement with the cam.

The upper end of the rod 22 is fixed to the center of a circular diaphragm 26 the central part of which is clamped between two rigid discs 28, 30 also held on the upper end of the rod 22.

The diaphragm 26 is thrust upwardly in a known manner by a helical spring 32.

The lower body 10 includes a flared upper part 34 which terminates in an annular peripheral flange 36. From the flange 36 rise a plurality of equiangularly spaced pins 38 (six in the case shown). The pins 38 are formed by moulding with the body 10.

The periphery of the diaphragm has a plurality of equiangularly spaced holes 40 through which the pins 38 extend.

An upper body 42 of rigid plastics material which preferably has some resilience is attached to the lower body 10.

The upper body 42 includes an annular peripheral flange 44 with a series of equiangularly spaced holes 46 through each of which extends one of the pins 38.

The periphery of the diaphragm 26 is clamped between the two flanges 36, 44.

During assembly of the two bodies 10, 42 of the pump, after the two flanges 36, 44 have been applied against each other with the interpositioning of the periphery of the diaphragm 26, the pins 38 are subject to hot deformation (for example, by ultrasonics) so that a head 48 is formed on each pin. The two bodies 10, 42 are firmly held together by these heads 48. Moreover, the periphery of the diaphragm 26 acts as a sealing washer clamped between the flanges 36,44.

From the flange 44 of the upper body 42 rises a superstructure 50 which is formed by moulding and has a cross-section essentially in the form of a figure-eight. The superstructure 50 defines a pair of cylindrical cavities 52, 54 which are side-by-side but separate.

The bottoms of the two cavities 52, 54 are defined by transverse partitions 56, 58 which provide for the housing of an automatic delivery valve, generally indicated 60, and an automatic intake valve, generally indicated 62, respectively.

By means of the valves 60, 62 the two delivery and intake cavities 52, 54 are placed in alternate communication, in a known manner, with a chamber 64 overlying the diaphragm 28, when the latter is deformed in a reciprocating manner by the mechanism including the lever 15 and the rod 22.

The two cavities 52, 54 have the same diameter and terminate at their upper ends with respective annular bell-shaped parts of revolution 65, 66. These bell-shaped parts 65, 66 have the same shape and size, and have thin walls to allow them to deform resiliently. Each of the latter has a respective annular groove 68, 70 within it.

Each bell-shaped part 65, 66 also has a respective annular groove 72, 74 constituting a seat for a respective toroidal sealing ring 75, 77.

To each cavity 52, 54 is attached a respective cap 76, 78 constituted by a moulded piece of rigid plastics material having some resilience.

Each cap 76, 78 has a respective tubular appendage 80, 82 which acts as a pipe union, in particular, in the case shown, the pipe union 80 is a delivery pipe union while the pipe union 82 is an intake pipe union.

Figure 2:
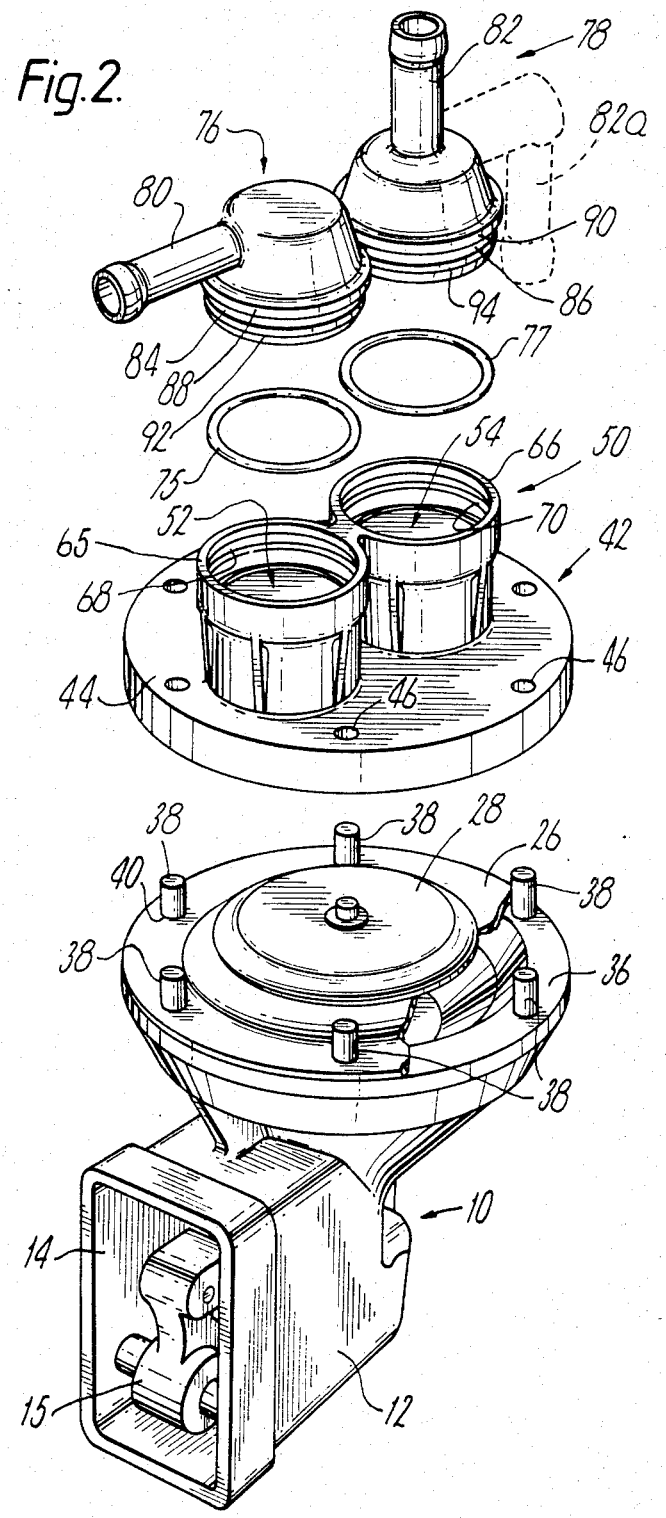
FIG. 2 is an exploded perspective view.

Solely by way of example, the pipe union 80 has been shown branching radially from the cap 76, while the pipe union 82 branches axially from the cap 78. In FIGS. 1 and 2, a pipe union **82*a* of a different form is also shown in broken outline, which has a first part extending radially from the cap 78** and an end portion bent to form an elbow which projects downwardly.

Numerous other arrangements for the pipe unions are possible.

Each cap 76, 78 has a respective skirt of revolution 84, 86 which is defined at its upper end by a respective outer peripheral shoulder 88, 90.

Each skirt 84, 86 has a respective annular rib 92, 94 on its outer periphery. Moreover, each skirt terminates with a lower radial surface 96, 98.

As illustrated in FIG. 1, the skirts 84, 86 are snap-engaged in the respective bell-shaped parts 65, 66 with their coupling members, constituted by the ribs 92, 94 being engaged precisely in corresponding coupling members constituted by the grooves 68, 70. Under these conditions, the toroidal washers 75, 77 are clamped, in their seats 72, 74 between the radial surfaces 96, 98 of the caps 76, 78 and the corresponding radial surfaces constituting the bottoms of the seats 72, 74.

Given that the shapes and sizes of the bell-shaped parts 65, 66 and the skirts 84, 86 are identical, the various types of cap, such as 76 and 78, are interchangeable. Moreover, given the revolutionary form of the couplings of the skirts 84, 86 with the bell-shaped parts 65, 66 a cap with a radial pipe union, such as 80 or **82*a*, may be mounted on the upper body 50** in any orientation.

A pump according to the invention also offers a further possible orientation during first assembly. Given the equiangular spacing of the pins 38 and the corresponding holes 46 in the flange 44, the upper body 42 may be coupled to the lower body 10 in various relative angular positions (six positions in the case shown). This also allows the positions of the axes of the caps 76, 78 to be varied about the axis of the pump as a whole, that is, a variation of the positions of the caps 76, 78 relative to the flange 14 and hence relative to the engine to which the pump is fixed.

What is claimed is:

1. A diaphragm pump, of the type comprising a lower body and an upper body with mating annular peripheral flanges between which the periphery of the diaphragm is gripped, and in which the lower body contains a mechanism for deforming said diaphragm in a reciprocating manner, and in which said upper body is formed with two housings which contain respectively an automatic intake valve and an automatic delivery valve through which a chamber overlying the diaphragm is put into communication with an intake pipe union and a delivery pipe union respectively, which branch from corresponding spaces overlying the respective valves, characterised in that:

said upper body has a pair of separate cavities arranged side-by-side, each of which houses one of the valves and has an upper bell-shaped annular part of revolution; and associated with each cavity is a cap separate from said upper body and one another, each cap having a pipe union branching therefrom and having a skirt of revolution engaging the corresponding bell-shaped part, one forming an inlet and one forming an outlet; at least one of each bell-shaped part and the corresponding skirt being resilient; each skirt and the corresponding bell-shaped part having cooperating snap-engageable members and facing radial surfaces between which is clamped an annular sealing washer, at least one of said caps including said pipe union branching therefrom at an angle from the axis of said cap and said cap and pipe union rotatable to different tangential positions.

2. A diaphragm pump according to claim 1, characterised in that the cooperating snap-engageable members of each bell-shaped part and each cap corresponding comprise an annular rib and an annular groove respectively.

3. A diaphragm pump according to claim 1, characterised in that each bell-shaped part is of identical shape and size and each skirt is of identical shape and size.

4. A diaphragm pump according to claim 1, characterised in that the two cavities with their bell-shaped parts are formed in a super-structure which rises from the flange of the upper body and has a cross-section substantially in the form of a figure-eight.

5. A diaphragm pump according to claim 1, characterised in that the upper body and/or the caps are of rigid plastics material with some resilience.

6. A diaphragm pump according to claim 1, characterised in that the flanges are provided with means for fixing them together in a plurality of relative angular positions.

7. A diaphragm pump according to claim 6, characterised in that the lower body comprising thermoplastics material and has a plurality of equiangularly spaced pins rising from its flange, said pins being inserted in corresponding equiangularly spaced holes in the flange of the upper body; said pins having deformed enlarged heads to hold the two flanges together with the interpositioning of the periphery of the diaphragm.

* * * * *